US009951915B2

(12) United States Patent
Hierzer

(10) Patent No.: US 9,951,915 B2
(45) Date of Patent: Apr. 24, 2018

(54) PLANAR STRIP LIGHT FOR INSTALLATION IN A PLASTERBOARD CONSTRUCTION

(71) Applicant: H4X e.U., Graz (AT)

(72) Inventor: Andreas Hierzer, Graz (AT)

(73) Assignee: H4X E.U., Graz (AT)

( * ) Notice: Subject to any disclaimer, the term of this patent is extended or adjusted under 35 U.S.C. 154(b) by 488 days.

(21) Appl. No.: 14/564,868

(22) Filed: Dec. 9, 2014

(65) Prior Publication Data

US 2015/0260354 A1 Sep. 17, 2015

(30) Foreign Application Priority Data

Mar. 12, 2014 (DE) ..... 10 2014 204 544

(51) Int. Cl.

| | |
|---|---|
| ***F21K 99/00*** | (2016.01) |
| ***F21S 8/02*** | (2006.01) |
| ***F21V 21/04*** | (2006.01) |
| ***F21S 4/28*** | (2016.01) |
| *F21Y 115/10* | (2016.01) |

(52) U.S. Cl.

CPC ..... *F21S 8/026* (2013.01); *F21S 4/28* (2016.01); *F21V 21/04* (2013.01); *F21Y 2115/10* (2016.08)

(58) Field of Classification Search

CPC ..... F21V 19/0055; F21V 19/004; F21S 8/024

See application file for complete search history.

(56) References Cited

U.S. PATENT DOCUMENTS

| | | | | |
|---|---|---|---|---|
| 6,957,896 | B2 * | 10/2005 | Burgess | F21S 8/026 362/147 |
| 2005/0060949 | A1 * | 3/2005 | McNaught | F21S 8/02 52/28 |
| 2008/0273323 | A1 * | 11/2008 | Ladstaetter | F21S 8/04 362/231 |
| 2009/0116241 | A1 * | 5/2009 | Ashoff | F21V 33/006 362/253 |
| 2010/0245109 | A1 | 9/2010 | Ashoff et al. | |
| 2011/0134651 | A1 * | 6/2011 | Berman | F21S 8/02 362/365 |
| 2012/0163024 | A1 * | 6/2012 | Edamitsu | F21V 5/02 362/611 |
| 2013/0250549 | A1 * | 9/2013 | Park | F21L 4/02 362/97.1 |
| 2013/0314907 | A1 * | 11/2013 | Swisha | F21V 21/02 362/147 |
| 2014/0313776 | A1 * | 10/2014 | Grigore | G02B 6/0091 362/612 |

FOREIGN PATENT DOCUMENTS

DE 20 2011 000 426 U1 5/2011

* cited by examiner

*Primary Examiner* — Elmito Breval

(74) *Attorney, Agent, or Firm* — Nutter McClennen & Fish LLP; John J. Penny, Jr.

(57) ABSTRACT

The invention relates to a planar strip light for installation in a plasterboard construction, wherein the strip light comprises an optical unit which has a reflector and an LED panel, wherein the light-emitting side of the LED panel is arranged at the edge of the reflector and substantially perpendicular to the reflector in order to reduce the installation depth of the strip light, and wherein the strip light comprises fasteners for its direct fastening to the plasterboard construction.

20 Claims, 3 Drawing Sheets

PLANAR STRIP LIGHT FOR INSTALLATION IN A PLASTERBOARD CONSTRUCTION

CROSS REFERENCE TO RELATED APPLICATIONS

This application claims the benefit of German patent application No. 10 2014 204 544.4, filed Mar. 12, 2014, the entire disclosure of which is herein incorporated by reference.

TECHNICAL BACKGROUND

DE 20 2011 107 736 U1 discloses an LED flush-mounted light fitting for suspended ceilings, the LED tubes being directly built into the suspended ceiling without an additional support unit, and the length of the LED tubes is adjusted to the modular dimensions of the ceiling construction, and the electrically non-conductive end pieces are formed so as to fit the profiled rails of the ceiling construction, additional mounting rails to the sides of the LED tubes being used as supports for the ceiling panels. A drawback of this design is the considerable complexity of the mounting of the flush-mounted light fitting, since the mounting rails have to be attached first, whereby the time taken to install the lighting system is lengthened and at the same time the cost of the lighting system is increased.

SUMMARY OF THE DISCLOSURE

It is therefore an idea of the invention to provide a simplified strip light for installation in a plasterboard construction, in which the number of components needed for installing the strip light is reduced and the complexity of the mounting is reduced, and at the same time an installation profile that is as planar as possible is produced.

The invention provides a planar strip light in which the light from the LED panel is coupled laterally from the reflector, and that the power supply unit for electrically supplying the electrical consumers of the planar strip light are arranged outside said strip light. Owing to this measure, the installation depth of the strip light can be advantageously reduced, so that mounting of the front face of the strip light flush with the adjacent plaster boards is ensured, which leads to an aesthetically pleasing shape of the installed strip light. In a variant of the strip light in which the power supply unit for electrically supplying the optical unit of the planar strip light is arranged outside the strip light, the installation depth is approximately 15-20 mm. In a further variant of the planar strip light in which the power supply unit for electrically supplying the optical unit of the planar strip light is arranged behind the optical unit, the installation depth of the planar strip light is approximately 35-40 mm.

Within the context of the present invention, a planar strip light means a structure in which an optical unit is provided as a device having an extension, in a longitudinal direction or in a curved shape, as a planar component for (directly) mounting said planar strip light on a plasterboard construction. According to a variant of the present strip light, a support unit may also be provided in which the optical unit of the planar strip light is received.

Furthermore, owing to the direct fastening of the strip light to the plasterboard construction, the present strip light is advantageous in that the connection to the sub-construction of the plasterboard construction (for example to a mounting profile) or to the prefabricated wall or to the ceiling can be direct, so that the hitherto necessary modification to the sub-construction (for example by sawing away regions of the mounting profiles of the plasterboard construction) for ensuring flush mounting of the strip light can be dispensed with, whereby the complexity of mounting the present planar strip light is considerably reduced.

For this purpose, the present invention provides a planar strip light for installation in a plasterboard construction, the strip light comprising an optical unit which has a reflector and an LED panel, the light-emitting side of the LED panel being arranged at the edge of the reflector and substantially perpendicular to the reflector in order to reduce the installation depth of the strip light, and the strip light comprising fasteners for direct fastening to the plasterboard construction. In addition, the present strip light may have a light-permeable cover, which is for example opal or microprismatic. Furthermore, the light-permeable cover may be made of a plastic material.

According to a further configuration of the present strip light, the fastener may be a screw. As a result, the strip light can be connected to the plasterboard construction in a particularly cost-effective and time-saving manner.

According to a further configuration of the present strip light, the fastener may be a spring connection. In this case, the spring connection may surround, at least in part or completely, the associated structure for mounting to the plasterboard construction, more particularly a prefabricated wall or rails of the plasterboard construction.

According to a further configuration of the present strip light, a support unit may be provided, into which the optical unit is fastened by the strip light so as to be replaceable. As a result, flexibility is advantageously increased for the customer, since even after its mounting the strip light, can still be replaced simply, which is suitable both for retrofitting the optical unit and for its replacement in the event of damage. The support unit is preferably formed in the manner of a hollow profile, more particularly an extruded hollow profile. The support unit may be substantially straight along its longitudinal axis. Alternatively, the support unit may also be curved, more particularly planar, along its longitudinal extension.

According to a further configuration of the present strip light, the optical unit may be clipped into the support unit. As a result, this makes it possible to rapidly and effectively replace the optical unit in the support unit.

According to a further configuration of the present strip light, at least one fastener may be provided, which is arranged behind the plasterboard construction, more particularly a plaster board of the plasterboard construction, and laterally adjacent to the strip light. The fastener may preferably be formed in the manner of a profile which extends at least in portions along the support unit. In addition, the fastener may be formed in the manner of an L-shaped profile, one leg of the profile being arranged behind the plasterboard construction or the plaster board and the other leg of the profile being arranged laterally adjacent to the strip light.

According to a further configuration of the present strip light, the fastener may be screwed to the strip light or to the support unit. This produces a simple and efficient connection of the fastener to the strip light or the support unit.

According to a further configuration of the present strip light, the support unit may be provided as a plaster profile. This makes it possible for the support unit to be connected to the adjacent plaster boards in an aesthetically pleasing manner.

According to a further configuration of the present strip light, the outer surface of the support unit may have a plaster portion, in which a plurality of teeth is formed. The plurality of teeth advantageously ensures that the plaster that is applied is held on the support unit in an improved manner.

According to a further configuration of the present strip light, said strip light may comprise a power supply unit which can be electrically connected to the optical unit and is arranged behind the optical unit. This configuration makes it possible for the power supply unit to be combined with the strip light, which can be installed in a single working step.

According to a further configuration of the present strip light, said strip light may comprise a power supply unit which can be electrically connected to the optical unit and is arranged outside the strip light. In so doing, the thickness of the strip light is particularly advantageously reduced. The power supply unit may, for example, be arranged to the side of the strip light. Alternatively, the power supply unit may be arranged between rails of the plasterboard construction.

According to a further configuration of the present strip light, the plasterboard construction may comprise a prefabricated wall, rails attached to the prefabricated wall and plaster boards attached to the rails, and the strip light is arranged between a recess in the plasterboard, which strip light is flush with the surface of the adjacent plasterboard. This advantageously leads to an aesthetically pleasing shape of the installed strip light.

BRIEF DESCRIPTION OF THE DRAWINGS

The present invention is explained with reference to the accompanying drawings, in which.

DETAILED DESCRIPTION OF THE INVENTION

Figure 1:
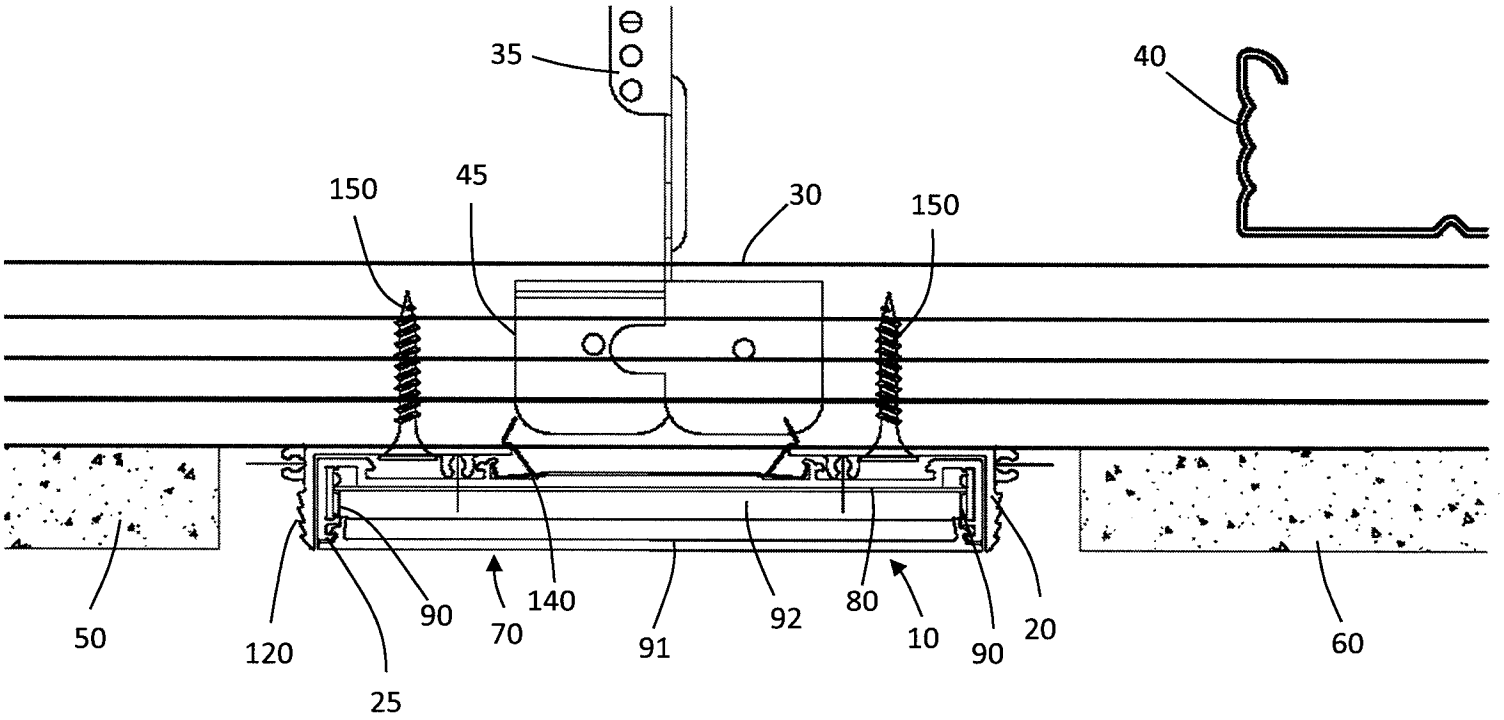
FIG. 1 is a plan view of a planar strip light according to a first embodiment of the present invention.

FIG. 1 is a plan view of a planar strip light 10 according to a first embodiment of the present invention.

Here, the planar strip light 10 is provided for installation in a plasterboard construction, which comprises a prefabricated wall (not shown), rails 30, 40 attached to the prefabricated wall and plaster boards 50, 60 attached to the rails 30, 40, the strip light 10 comprising an optical unit 70 which has a reflector 80 and two LED panels 90, the light-emitting side of the LED panels 90 being arranged at the edge of the reflector 80 and substantially perpendicular to the reflector 80 in order to reduce the installation depth of the strip light 10. The strip light 10 comprises fasteners for its direct fastening to the plasterboard construction.

Since the strip light 10 is arranged between a recess in the plasterboard 50, the strip light 10 is flush with the surface of the adjacent plaster boards 50, 60, which makes the planar strip light appear particularly aesthetically pleasing to an observer.

The rails 30, 40 are preferably formed in the manner of CD profiles which are known to a person skilled in the art. A rail 30 may be connected to the prefabricated wall or to a ceiling (not shown) using a connector 35 which at one end comprises a mounting portion 45 for its connection to the rail 30. The rails 30, 40 of the plasterboard construction may, depending on the structural requirements, be arranged in a vertical or horizontal direction, it also being possible to arrange them obliquely.

The planar strip light 10 comprises a support unit 20, into which the optical unit 70 is fastened by the strip light 10 so as to be replaceable. The fastener for fastening the strip light 10 to the rail 30 is formed as a pair of screws 150 which directly connect the support unit 20 to the rail 30. Furthermore, the support unit 20 is provided as a plaster profile, so that the outer surface of the support unit 20 has a plaster portion 120, in which a plurality of teeth is formed.

Furthermore, the support unit 20 is formed such the optical unit 70 can be replaced in the strip light 10. Particularly preferably, the optical unit 70 is clipped into the support unit 20 by means of a clip element 140.

The optical unit 70 is installed in an extruded aluminium profile 25, so that it can be easily removed from the support unit 20, using the clip element 140. The optical unit 70 comprises the two LED panels 90, a reflector 80 and a light guide plate 92, the reflector 80 and the light guide plate 92 being arranged in the front region of the support unit 20 in the region of the LED panels 90, interposed between the LED panels 90. The reflector 80 is preferably a highly reflective reflector. The light guide plate 92 is printed, laser-cut or embossed. Alternatively, the light guide plate 92 may also be formed as a silicone plate. The optical unit 70 is closed by a cover 91, it also being possible for the cover 91 to function as a microprism plate.

Furthermore, a power supply unit (not shown) is provided, which can be electrically connected to the optical unit 70 and is arranged outside the optical unit 70.

Figure 2:
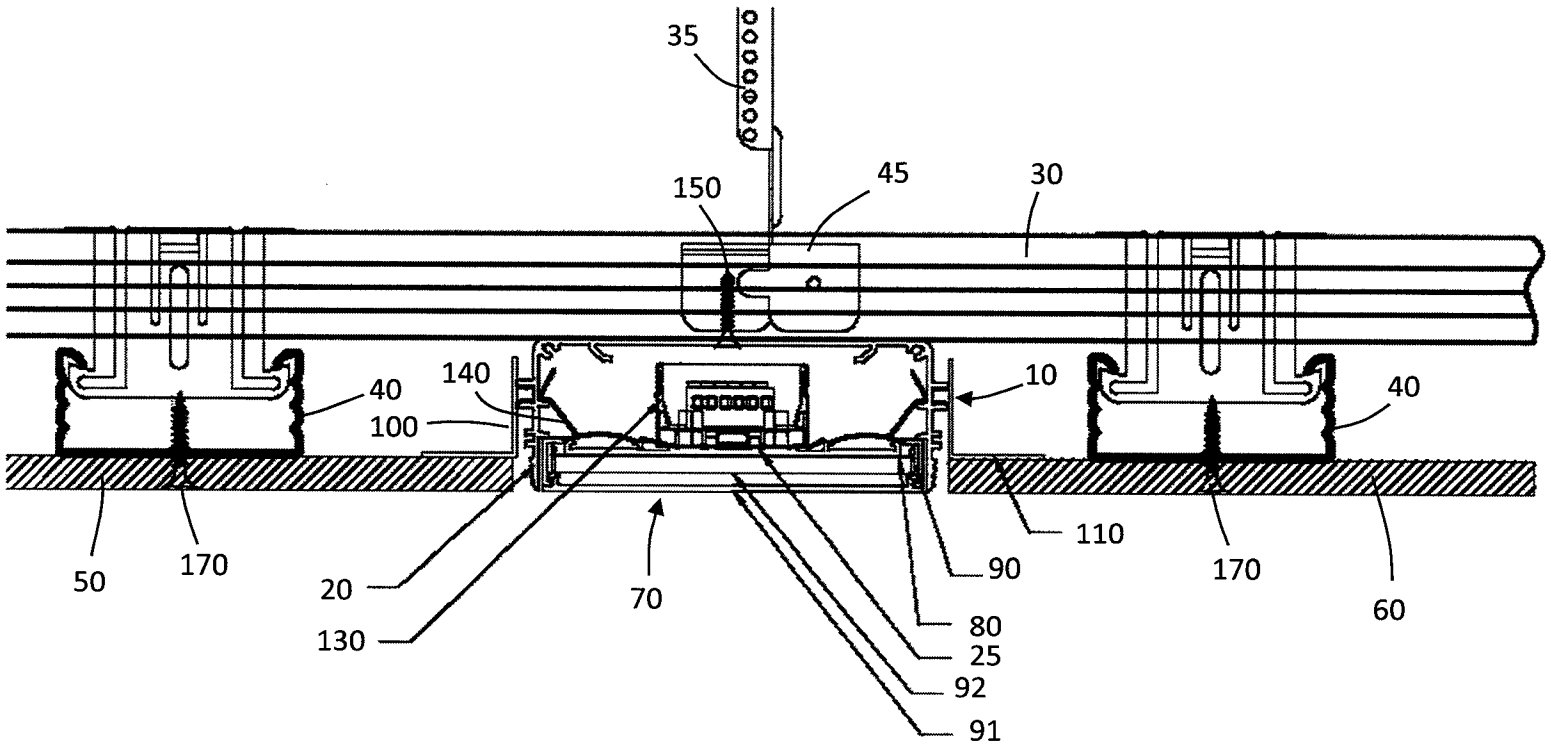
FIG. 2 is a plan view of a planar strip light according to a second embodiment of the present invention.

FIG. 2 is a plan view of a planar strip light 10 according to a second embodiment of the present invention.

Since the basic construction of the planar strip light 10 is similar to that according to the first embodiment in FIG. 1, only differences from the first embodiment shall be explained in the following.

The planar strip light 10 comprises a power supply unit which can be electrically connected to the optical unit 70 and is arranged behind the optical unit 70 within the support unit 20.

Furthermore, fasteners 100, 110 are provided which are arranged behind the plaster board 50 and laterally adjacent to the strip light 10. The fasteners 100, 110 are each screwed (not shown) to the support unit 20. The fasteners 100, 110 are formed in the manner of a profile which extends at least along the support unit 20. More precisely, the fasteners 100, 110 are formed in the manner of an L-shaped profile, one leg of the profile being arranged behind the plaster board 50 and the other leg of the profile being arranged laterally adjacent to the support unit 20 of the strip light 10.

Figure 3:
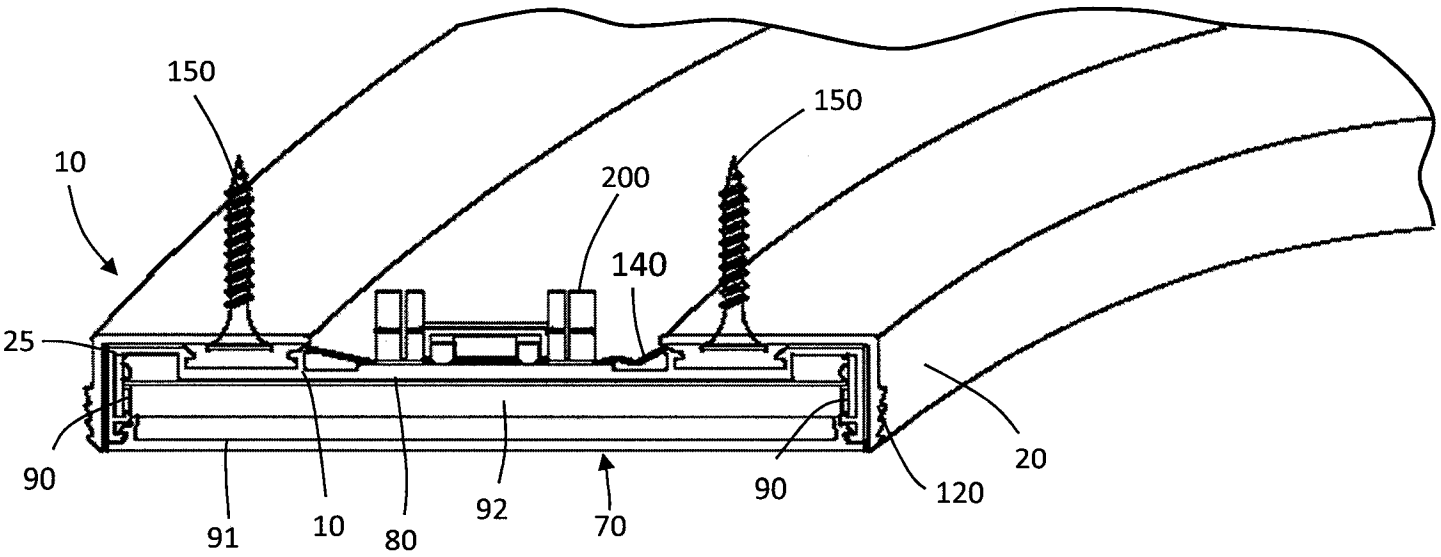
FIG. 3 is a perspective view of a planar strip light according to a third embodiment of the present invention.

FIG. 3 is a perspective view of a planar strip light according to a third embodiment of the present invention.

Since the basic construction of the planar strip light 10 is similar to that according to the first embodiment in FIG. 1, only differences from the first embodiment shall be explained in the following.

The support unit 20 of the planar strip light 10 is formed in the manner of an extruded profile and has a curved, more particularly planar, shape along its longitudinal extension. Furthermore, an electrical contact element 200 is arranged on the support unit 20, which element is provided for contacting a power supply unit (not shown).

What is claimed is:

1. A planar strip light for installation in a plasterboard construction, wherein the strip light comprises an optical unit which has a reflector and an LED panel, wherein the light-emitting side of the LED panel is arranged at the edge of the reflector and substantially perpendicular to the reflector in order to reduce the installation depth of the strip light, wherein the strip light comprises fasteners for its direct fastening to the plasterboard construction, and wherein the strip light comprises a support unit formed as an extruded profile, the optical unit being configured to be fastened into the support unit so as to be replaceable, such that the optical unit is still replaceable after mounting the strip light, the optical unit being removable from the support unit.

2. The planar strip light of claim 1, wherein the fastener is a screw.

3. The planar strip light of claim 1, wherein the fastener is a spring connection.

4. The planar strip light of claim 1, wherein the optical unit is fastened into the support unit so as to be replaceable.

5. The planar strip light of claim 4, wherein the optical unit is clipped into the support unit.

6. The planar strip light of claim 1, wherein at least one fastener is provided, which is arranged behind the plasterboard construction and laterally adjacent to the strip light.

7. The planar strip light of claim 6, wherein the fastener is screwed to the strip light or to the support unit.

8. The planar strip light of claim 6, wherein the support unit is provided as a plaster profile.

9. The planar strip light of claim 1, wherein the support unit is provided as a plaster profile.

10. The planar strip light of claim 6, wherein the support unit is curved, more particularly planar, along its longitudinal extension.

11. The planar strip light of claim 9, wherein the outer surface of the support unit has a plaster portion in which a plurality of teeth is formed.

12. The planar strip light of claim 1, wherein said strip light comprises a power supply unit which can be electrically connected to the optical unit and is arranged behind the optical unit within the support unit.

13. The planar strip light of claim 12, wherein the support unit is curved, more particularly planar, along its longitudinal extension.

14. The planar strip light of claim 1, wherein said strip light comprises a power supply unit which can be electrically connected to the optical unit and is arranged outside the strip light.

15. The planar strip light of claim 14, wherein the support unit is curved, more particularly planar, along its longitudinal extension.

16. The planar strip light of claim 1, wherein the support unit is curved, more particularly planar, along its longitudinal extension.

17. The planar strip light of claim 1, wherein the plasterboard construction comprises a prefabricated wall, rails attached to the prefabricated wall and plaster boards attached to the rails, and in that the strip light is arranged between a recess in the plaster boards, which strip light is flush with the surface of the adjacent plaster boards.

18. The planar strip light of claim 17, wherein the support unit is substantially straight along its longitudinal axis.

19. The planar strip light of claim 1, wherein the support unit is substantially straight along its longitudinal axis.

20. The planar strip light of claim 1, wherein an electrical contact element is arranged on the support unit, which element is provided for contacting a power supply unit.

* * * * *